United States Patent [19]

Cheong

[11] 4,098,328

[45] Jul. 4, 1978

[54] CROSS-FLOW RADIATOR DEAERATION SYSTEM

[75] Inventor: Alex Shu-Ki Cheong, Mississauga, Canada

[73] Assignee: Borg-Warner Corporation, Chicago, Ill.

[21] Appl. No.: 806,971

[22] Filed: Jun. 16, 1977

[51] Int. Cl.[2] ..... F01P 11/00

[52] U.S. Cl. ..... 165/107; 123/41.54; 165/111

[58] Field of Search ..... 165/107 D, 110, 111; 123/41.54, 41.21, 41.27

[56] References Cited

U.S. PATENT DOCUMENTS

| | | | |
|---|---|---|---|
| 1,677,981 | 7/1928 | Muir | 123/41.21 |
| 1,983,988 | 12/1934 | Mougey et al. | 165/110 X |
| 2,628,079 | 2/1953 | Haynes et al. | 165/72 |
| 2,713,973 | 7/1955 | Hencken et al. | 237/63 |
| 3,004,626 | 10/1961 | Brinen | 55/99 |
| 3,051,450 | 8/1962 | White et al. | 165/110 |
| 3,077,927 | 2/1963 | White et al. | 165/72 |
| 3,132,690 | 5/1964 | Suchomel | 165/110 |
| 3,254,707 | 6/1966 | Ferguson | 165/107 D X |
| 3,455,377 | 7/1969 | Hayes | 165/110 |
| 3,604,502 | 9/1971 | Morse et al. | 165/51 |
| 3,989,103 | 11/1976 | Cieszko et al. | 123/41.54 X |
| 4,006,775 | 2/1977 | Avrea | 165/51 |

FOREIGN PATENT DOCUMENTS

| | | | |
|---|---|---|---|
| 1,270,238 | 4/1972 | United Kingdom | 123/41.54 |

*Primary Examiner*—Albert W. Davis, Jr.
*Attorney, Agent, or Firm*—James A. Geppert

[57] ABSTRACT

A deaeration system for a cross-flow radiator requiring continuous deaeration utilized with an internal combustion engine, wherein the radiator includes a vertical inlet tank and a vertical outlet tank connected by a tube and fin core. A generally vertical baffle divides the outlet tank into two compartments, one of which functions as a receiver tank for the core while the other compartment functions as a reservoir tank having a filler neck for a cap and pressure relief valve communicating therewith, and the radiator fluid outlet communicates with the reservoir tank adjacent the bottom thereof.

11 Claims, 3 Drawing Figures

12
21
33
10
29
11
22
13
15
34
14

15

33
21
29
3
32
28
31
27
23
24
13
16
34
18
17
14
3
25
19
26

33
31
29
12
32
22
22
27
13
24
18
14
19
26

CROSS-FLOW RADIATOR DEAERATION SYSTEM

BACKGROUND AND SUMMARY OF THE INVENTION

In the cooling system for engines, such as an internal combustion engine, it is conventional practice to use a cooling radiator with spaced tanks and headers interconnected by a core including a plurality of tubes extending between the tanks and having fins therebetween to promote heat transfer to air passing through the fins and around the tubes.

One of the factors which reduces the efficiency of a radiator, by adversely affecting the engine coolant pump flow, is entrapped air and other gases in the coolant system. The entrapped air and gases also serve to reduce engine life. Various systems have been proposed for deaeration of the radiator to overcome the above problems with varying degrees of success. A separate surge tank has been inserted into the cooling system for a cross-flow radiator to provide space for fluid expansion and contraction with changes in temperature, to act as a reservoir for the coolant, and to act as a means for filling the cooling system and for separating entrapped air in the coolant.

More recently, one of the header tanks for the cross-flow radiator has been modified by incorporating a high velocity chamber and an intercommunicating low velocity chamber. The low velocity or reserve chamber provides a location where reserve coolant and entrapped air or gases are collected and the gases are vented through a filler cap and/or pressure relief valve. However, these systems are relatively complicated in requiring standpipes, float valves and/or venturis to insure proper operation of the deaeration system. The present invention overcomes the problems inherent in previously known systems to provide a simplified and efficient deaeration system.

The present invention contemplates the provision of a novel deaeration system for a cross-flow radiator utilizing a reservoir tank integrated into the outlet tank of the radiator. The outlet tank is divided by a baffle to provide a receiver tank communicating with the ends of the tubes forming the radiator core and a reservoir tank having the coolant outlet communicating adjacent the bottom thereof. The baffle is perforated on a portion of its surface to allow the passage of coolant and entrapped air therethrough, and a deflector is formed in the upper end of the receiver tank to deflect air or gases separating from the coolant over the upper edge of or through the perforations in the baffle to the reservoir tank.

The present invention also comprehends the provision of a novel deaeration system for a cross-flow radiator wherein the engine vent is connected to the receiver tank under the water level therein during operation to create a water lock after shut down, but above the water level before the engine is filled with coolant, thus allowing a proper venting of the engine and radiator during refill.

The present invention further comprehends the provision of a novel deaeration system for a cross-flow radiator wherein the conventional standpipes and by-pass lines have been eliminated. This system provides for an easy initial fill and/or refill of the cooling system wherein filling occurs through the outlet instead of through a by-pass or make-up line.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENT

Figure 1:
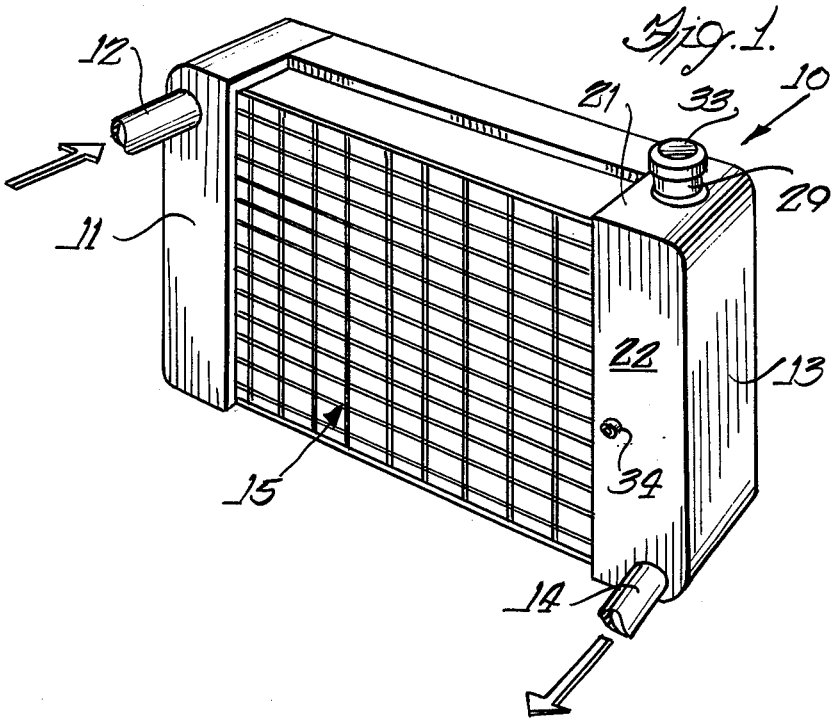
FIG. 1 is a perspective view of a vehicle cross-flow radiator embodying the present invention.

Referring more particularly to the disclosure in the drawing wherein is shown an illustrative embodiment of the present invention, FIG. 1 discloses a cross-flow radiator 10, for use in an automotive vehicle of the internal combustion engine type, including a vertical inlet tank 11 having an inlet port 12 positioned adjacent the upper end thereof and a vertical outlet tank 13 having an outlet port 14 positioned adjacent the lower end thereof; the tanks being interconnected by a radiator core 15 comprising a plurality of parallel tubes 16 opening into the tanks and a plurality of fins 17 interconnecting the tubes 16 and enhancing the heat transfer from the coolant passing through the tubes to air passing through the fins.

Figure 2:
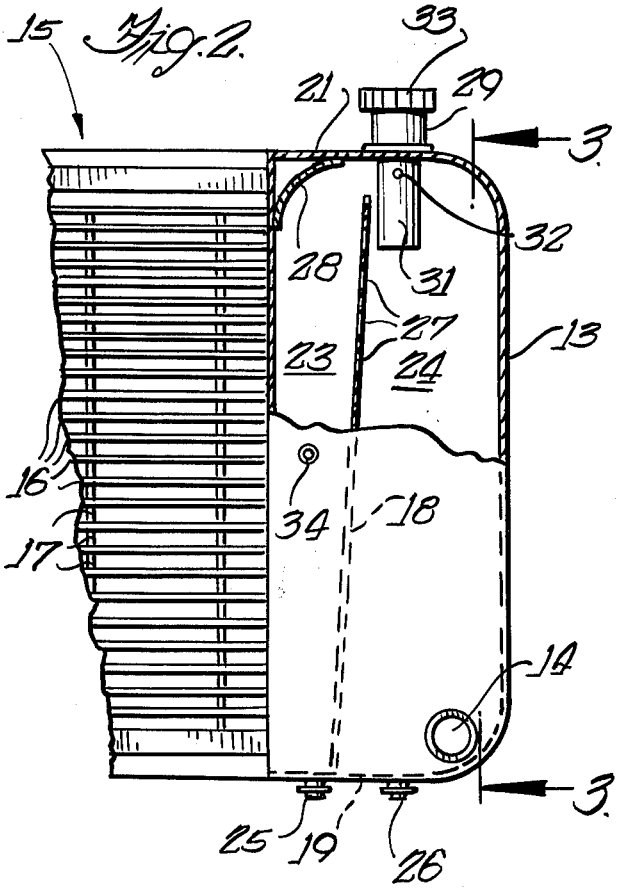
FIG. 2 is a partial vertical cross sectional view of the tube core and outlet tank of the radiator.
Figure 3:
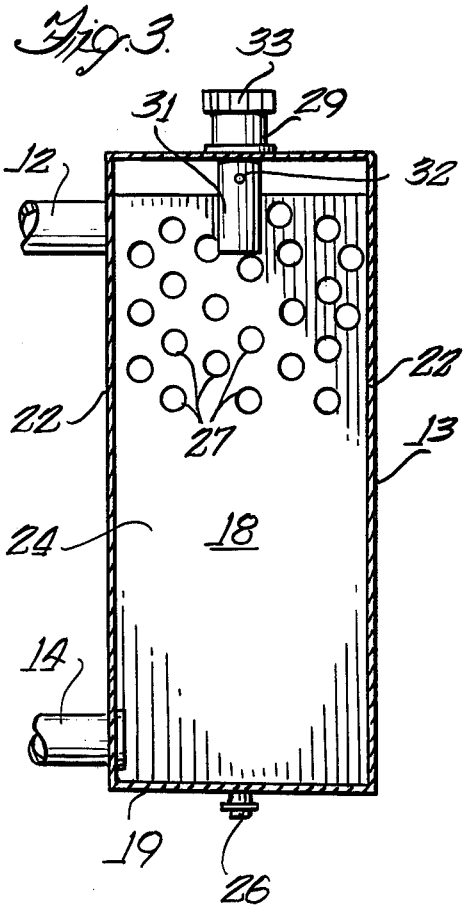
FIG. 3 is a vertical cross-sectional view taken on line 3—3 of FIG. 2.

With reference to FIGS. 2 and 3, the outlet tank 13 is enlarged relative to the inlet tank 11 and has a generally vertical baffle 18 located in the tank and extending from the bottom wall 19 to or terminating short of the top wall 21 of the tank; the baffle extending completely between the tank sides 22, 22 and sealingly joined thereto to form a receiver tank 23 and a reservoir tank 24. A drain cock 25 communicates with the receiver tank 23, and a second drain cock 26 in is the bottom wall 19 communicating with the reservoir tank 24 for use in emptying the system; although a single drain cock 25 or 26 may be utilized if there is an opening at the bottom of the baffle 18 communicating between the chambers 23 and 24. Also, the outlet port 14 enters the tank 13 to communicate with the lower end of the reservoir tank 24.

The baffle 18 is provided with a plurality of perforations or openings 27 over a portion of its surface (shown as in the upper portion of the baffle in FIGS. 2 and 3) to allow the flow of coolant into the reservoir tank 23. A curved deflector 28 is positioned at the top wall 21 and adjacent the core 15 to direct fluid and entrapped air towards the reservoir tank over or through the baffle. A filler neck 29 is positioned in the top wall 21 over the reservoir tank and has an extension 31 depending below the top wall 21. A pressure cap 33 is received on the filler neck and includes a pressure relief valve therein (not shown) to allow the escape of entrapped air or gases. One or more vent openings 32 are formed in the extension 31 above the fluid level to vent trapped air or gases into the filler neck 29. Also, a port 34 is positioned in the back wall 22 to communicate between the receiver tank 23 and a vent for the engine, which may be on the thermostat housing (not shown).

This cooling system is filled through the filler spout or neck 29 rather than the conventional method of filling through a by-pass line, which is eliminated in the present system. Coolant initially fills the reservoir tank 24 and flows through the outlet port 14 to fill the coolant jacket for the vehicle engine. As the vent port 34 is above the fluid level before the engine is filled and communicates with the engine vent, the port allows a proper venting of the engine and radiator during filling. As the reservoir tank 24 fills, coolant passes through the openings 27 to begin filling the receiver tank 23, the tubes 16 in the core and the inlet tank 11. When filling is complete, the pressure cap 33 is secured onto the filler neck 29.

Although the system may be carefully filled, there will be some entrapped air present in the cooling system, and when the engine is first started up, the air and gases will be rapidly transferred through the inlet tank 11 and radiator core 15 to the receiver tank 23 where the coolant will be in a state of turbulence. As the fluid moves upward to pass through the perforations 27 in the baffle 18 and enters the reservoir tank 24 and moves downward toward the outlet port 14 the entrapped air or gases rise to the upper portion of the tank 24. The reservoir tank 24 is so designed that its cross-sectional area will provide a downward coolant velocity less than the rising velocity of the entrapped gas bubbles so as to complete the separation of the entrapped air or gas from the coolant. The coolant, substantially free of entrapped air or gases, exits through the outlet port 14 at the bottom of the reservoir tank 24 to be propelled by the water pump (not shown) in the engine into the cooling jacket for the engine.

If the volume of entrapped gases in the reservoir tank 24 becomes excessive, the pressure relief valve in the pressure cap 33 will allow the escape of the gases into the ambient atmosphere. Leaks in the system may allow the entrance of gases into the coolant jacket and these gases are carried by the fluid to the radiator where they are separated from the fluid. Also, the engine vent allows the escape of gases to the receiver tank 23 through the vent port 34. When the engine is shut down or operated at very low speeds, the vent port 34 is under the fluid level in the receiver tank so as to create a fluid lock after shut down so that air does not re-enter the engine and radiator core as the water level in the system equalizes.

To drain the system, the two drain cocks 25 and 26 are opened and the pressure cap 33 removed. There is no syphon tube or standpipe involved in the present design, nor is there a by-pass or shunt line required. The baffle is shown as being substantially vertical in orientation, however, the specific baffle designs and the arrangement of perforations therein can have considerable variation in shape and position depending on the fluid flowrate required for the radiator.

I claim:

1. A deaerating radiator comprising a core having a plurality of parallel tubes extending horizontally, a first vertical tank communicating with the first ends of the horizontal tubes, a second vertical tank communicating with the opposite ends of said tubes, a fluid coolant inlet communicating with said first tank and a fluid coolant outlet communicating with said second tank, a baffle in the second tank dividing the tank into a receiver tank adjacent the core and a reservoir tank, said baffle being slightly inclined upwardly away from the core and having perforations in a portion thereof, and a filler neck in said second tank and having a depending extension.

2. A deaerating radiator as set forth in claim 1, in which said fluid outlet is positioned adjacent the bottom of said reservoir tank.

3. A deaerating radiator as set forth in claim 1, including an engine vent port in the second tank communicating with said receiver tank intermediate the upper and lower ends thereof.

4. A deaeration radiator as set forth in claim 1, including a curved deflector adjacent the core on the upper wall of said second tank.

5. A deaerating radiator as set forth in claim 1, in which said fluid inlet is positioned adjacent the upper end of said first tank.

6. A deaerating radiator as set forth in claim 2, in which said receiver tank receives fluid from the core in a turbulent state, and said reservoir tank allows the entrapped gases to separate from the fluid therein which is in a relatively quiescent state.

7. A deaerating radiator as set forth in claim 1, in which said fluid inlet is located adjacent the upper end of said first tank, said fluid outlet is positioned adjacent the lower end of the reservoir tank in said second tank, said baffle having perforations in the upper portion thereof, an engine vent port positioned intermediate the ends of said second tank and communicating with said receiver tank, and a pressure cap having a pressure relief valve therein adapted to close said filler neck.

8. A deaerating radiator as set forth in claim 7, including a curved deflector at the upper end of said second tank adjacent the core to deflect entrapped gases through said baffle.

9. A deaerating radiator comprising a core having a plurality of parallel tubes extending horizontally, a first vertical tank communicating with the first ends of the horizontal tubes, a second vertical tank communicating with the opposite ends of said tubes, a fluid coolant inlet communicating with the upper end of said first tank and a fluid coolant outlet communicating with said second tank, a baffle in said second tank inclined upwardly away from said core dividing the tank into a receiver tank adjacent the core and a reservoir tank, said baffle having perforations in the upper portion thereof, a curved deflector at the upper end of said second tank adjacent the core to deflect entrapped gases through said baffle, said fluid outlet being positioned adjacent the lower end of the reservoir tank, an engine vent port positioned intermediate the ends of said second tank and communicating with said receiver tank, a filler neck in said second tank and having a depending extension, and a pressure cap having a pressure relief valve therein adapted to close said filler neck, the coolant fluid being in a turbulent state from said core in said receiver tank and separated from the entrapped gases and in a quiescent state in said reservoir tank.

10. A deaerating radiator as set forth in claim 9, in which said extension has vent openings therein adapted to be located above the fluid coolant level in the reservoir tank to vent trapped gases into said filler neck.

11. A deaerating radiator as set forth in claim 7, in which said engine vent port is under the fluid level of the filled radiator to create a fluid lock upon shut-down of the system.

* * * * *